US011143480B1

(12) United States Patent
Wilson

(10) Patent No.: US 11,143,480 B1
(45) Date of Patent: Oct. 12, 2021

(54) ARMS POWER CLEANING LUBRICATION COUPLER AND METHOD

(71) Applicant: Alfred Tucker Randolph Wilson, Kalispell, MT (US)

(72) Inventor: Alfred Tucker Randolph Wilson, Kalispell, MT (US)

(73) Assignee: Alfred T. R. Wilson, Kalispell, MT (US)

( * ) Notice: Subject to any disclaimer, the term of this patent is extended or adjusted under 35 U.S.C. 154(b) by 0 days.

(21) Appl. No.: 16/873,321

(22) Filed: Mar. 19, 2020

Related U.S. Application Data

(60) Provisional application No. 62/919,635, filed on Mar. 21, 2019.

(51) Int. Cl.
*F41A 29/04* (2006.01)
*F41A 29/02* (2006.01)

(52) U.S. Cl.
CPC ..... *F41A 29/04* (2013.01); *F41A 29/02* (2013.01)

(58) Field of Classification Search
CPC ..... F41A 29/04; F41A 29/02; F41A 29/00; B23B 2231/04
USPC ..... 42/95; 15/21.1, 104.2; 81/437; 408/223, 239 R
See application file for complete search history.

(56) References Cited

U.S. PATENT DOCUMENTS

| | | | | |
|---|---|---|---|---|
| 1,872,198 | A * | 8/1932 | Rixel, Jr. | F41A 29/02 15/104.095 |
| 3,609,790 | A * | 10/1971 | Butch | F41A 29/02 15/104.165 |
| 5,957,634 | A * | 9/1999 | Carpinetti | B23B 31/1071 408/226 |
| 6,282,998 | B1 * | 9/2001 | Beach | B25B 23/0035 81/437 |
| 8,429,846 | B2 * | 4/2013 | Krieger | F41A 29/02 42/95 |
| 2011/0239515 | A1 * | 10/2011 | Tennyson | F41A 29/02 42/95 |
| 2014/0338701 | A1 * | 11/2014 | Freytag | F41A 29/02 134/8 |

* cited by examiner

*Primary Examiner* — Reginald S Tillman, Jr.

(57) ABSTRACT

The Arms Power Cleaning Lubrication Coupler and Method enables gun barrel cleaning implements to be rotated by attachment to a chock of a motorized device such as to an electrical or battery powered drill. The coupler includes a body member having a tubular and linear configuration that defines an interior space. A first end of the body member is open and configured to receive and engage a drill chuck of the motorized device. A second end of the body member is open and includes an inner surface that is threaded and operable to receive and engage a cleaning implement such as a brush. In use, the motor may be engaged to rotate the wheel chuck which, in turn, rotates the body member, drill chuck and cleaning implement. The rotating cleaning implement provides enhances cleaning of an inside of a firearm barrel.

1 Claim, 1 Drawing Sheet

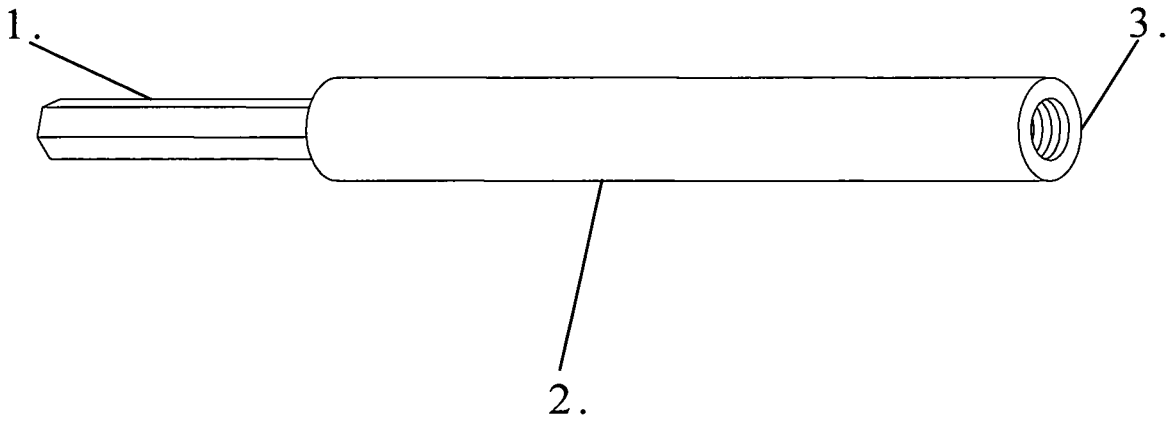
1.
3.
2.

ARMS POWER CLEANING LUBRICATION COUPLER AND METHOD

This is a continuation of application Ser. No. 62/919,635 filed Mar. 21, 2019.

BACKGROUND OF INVENTION

1. Field of Invention

The disclosed coupler and method is directed to firearms and ordnance weapons cleaning and lubrication. The Arms Power Cleaning Lubrication Coupler and Method is for improved interior barrel bore and chamber cleaning and lubrication.

2. Prior Art and Background of Invention

Since the dawn of the firearm to modern weapons, fouling from propellants and projectiles has contaminated interior barrel bores and chambers. Safety mandates the cleaning and lubrication of barrels and chambers.

Personnel still to this day push and pull cleaning implements, in and out of barrels and chambers. On the opposite end of these cleaning rods are rod end implements, for this task. Common rod end attachments are; cleaning brushes or cleaning lubrication patches or swabs. In some cases, the cleaning and or lubrication is not complete. This has resulted in arms failure, premature replacement, injury or death. Recently, there has been introductions in apparatus and chemicals. However, these lack efficiency, thoroughness or simplicity.

SUMMARY OF THE INVENTION

The Arms Power Cleaning Lubrication Coupler and Method allows for direct transmission from a separate power source, to cleaning and lubrication implements. This motor-powered coupler and method surpasses hand powered cleaning and lubrication of barrel bores and chambers. Securing this coupler to any drill chuck or motor power source, accomplishes this improved method. Personnel affix cleaning lubrication rods and or implements to one end of the coupler. To the opposite coupler end they secure the drive shaft or to a shaft provided motor. This creates; a stronger, faster, and more thorough method. Time is reduced, and operational quality is improved.

BRIEF DESCRIPTION OF DRAWING (1.) Hexagonal drive shaft (2,) Coupler body (3.) Threaded orifice

DETAILED DESCRIPTION OF DRAWING (1.) Is the direct drive hexagonal drive shaft. This is to secure in any drill chuck or cordless drill driver. This shaft is a selected size and cut to a determined length. (2.) The coupler body. A diameter is selected. The length is cut. On one the coupler's cut ends a hole is milled to a specified depth. This end is where the hexagonal direct drive shaft is fixed into this milled cavity. (3.) On the opposite end of the coupler's body a hole is drilled to a depth. This hole is threaded. The threaded end is where industry common cleaning lubrication rods and implements are secured, for this method use.

By starting a motorized power source, the coupler directly transmits force to the cleaning or lubrication implements from the motor. This transmission exceeds human powered operation. Resulting, in faster cleaner and complete lubrication of barrels and chambers. In another embodiment a shaftless coupler accepts motor or power source provided shafts or arbors. This entire product may be one piece formed, by extrusions, castings, but not limited to any fabrication process.

The invention claimed is:

1. A lubrication coupler for use with a motorized drill having a drill chuck, said lubrication coupler, comprising:

a body member having a tubular configuration and having a continuous side wall that defines an interior space, said body member having a first end that is open to allow access to said interior space and a second end opposite said first end and that is open to allow access to said interior space; and a shaft having an elongate and hexagonal configuration, said shaft having a proximal end coupled to said first end of said body member;

wherein said shaft includes a distal end having a configuration that is complementary to a configuration of the drill chuck and is selectively captured by the drill chuck wherein said first end of said body member has a configuration complementary to said shaft;

wherein said second end of said body member includes an inner surface having a threaded configuration operable for receiving a cleaning implement;

wherein said proximal end of said shaft is nested in said first end of said body member;

wherein said proximal end of said shaft is fixedly attached to said first end of said body member.

* * * * *